US005779107A

United States Patent [19]

French

[11] Patent Number: 5,779,107

[45] Date of Patent: Jul. 14, 1998

[54] PRESSURIZABLE CONTAINER ASSEMBLY AND PISTON MEMBER THEREFOR

[75] Inventor: Floyd R. French, Manchester, Mo.

[73] Assignee: Clayton Corporation, Fenton, Mo.

[21] Appl. No.: 791,104

[22] Filed: Jan. 24, 1997

[51] Int. Cl.[6] ..... B65D 88/60

[52] U.S. Cl. ..... 222/327; 222/389; 222/386

[58] Field of Search ..... 222/95, 327, 389, 222/386, 402.1

[56] References Cited

U.S. PATENT DOCUMENTS

| | | | |
|---|---|---|---|
| 3,275,200 | 9/1966 | Livingstone | 222/389 |
| 3,901,416 | 8/1975 | Schultz | 222/389 |
| 4,234,108 | 11/1980 | Diamond | 222/389 X |
| 5,400,926 | 3/1995 | Keller | 222/327 |
| 5,522,526 | 6/1996 | Delaforcade et al. | 222/389 X |
| 5,577,641 | 11/1996 | Delaforcade et al. | 222/389 X |
| 5,680,967 | 10/1997 | Dnag et al. | 222/327 |

*Primary Examiner*—Kenneth Bomberg
*Attorney, Agent, or Firm*—Louis E. Marn

[57] ABSTRACT

There is disclosed a piston member for a container comprised of a piston body of a diameter smaller by at least about 0.3 cm. (0.012") than the diameter of the inner surface of the container and formed with an upwardly and outwardly extending conically-shaped wiping wall portion having a wiping edge in sliding contact with the inner surface of the container to permit flexing of the wiping edge over imperfections, such as dents or bumps in the container thereby substantially eliminating potential for piston member stall as well as more efficacious product dispensing.

7 Claims, 1 Drawing Sheet

PRESSURIZABLE CONTAINER ASSEMBLY AND PISTON MEMBER THEREFOR

BACKGROUND OF THE INVENTION

1. Field of the Invention

This invention relates to a pressurizable container assembly for dispersing products, such as shaving gels, cheese, etc., and more particularly to an improved piston member for a pressurizable container assembly.

2. Brief Description of the Prior Art

Current pressurizable container assemblies include a container provided with a cylindrically-shaped piston member having a rigid cylindrically-shaped wiping edge in sliding contact with the interior surface of the container. The diameter of the piston member is substantially of like but slightly smaller than the interior diameter of the inner surface of the container. Consequently, when the piston member encounters a dent or bump (container imperfection) large enough to reduce the effective diameter of the can to less than the diameter of the piston member, piston stall and/or gas bypass into the product being dispersed may result. Additionally, a piston member without a wiping edge to avoid piston stall may inadequately wipe the interior surface leaving a thin film of cheese, e.g., 1.27 mm. (0.005") thick. Considering the sale of 35 million cans/year with a loss of about 2.27 gms (0.005 pds.) amounts to a loss of about 77,200 kg. (170,000#) of cheese.

OBJECTS OF THE INVENTION

An object of the present invention is to provide a piston member for a pressurizable container assembly substantially eliminating the potential for piston member stall.

Another object of the present invention is to provide a piston member for a pressurizable container assembly providing a more efficient wiping edge thereby improving total dispensing of product.

SUMMARY OF THE INVENTION

These and other objects of the present invention are achieved by a piston member for a container comprised of a piston body of a diameter smaller by at least about 0.3 cm.(0.012") than the diameter of the inner surface of the container and formed with an upwardly and outwardly extending conically-shaped wiping wall portion having a wiping edge in sliding contact with the inner surface of the container to permit flexing of the wiping edge over imperfections, such as dents or bumps in the container thereby substantially eliminating potential for piston member tall as well as more efficacious product dispensing. The wiping wall portion depending on consistency of the product being dispensed may include segments of smaller thickness extending downwardly from the wiping edge.

BRIEF DESCRIPTION OF THE DRAWINGS

Further objects and advantages of the present invention will become apparent from the following detailed description when taken with the accompanying drawings wherein.

DETAILED DESCRIPTION OF THE DRAWINGS

Figure 2:
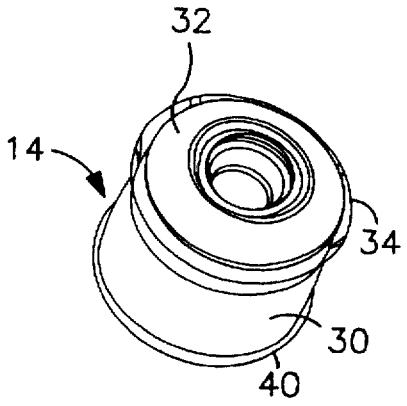
FIG. 2 is an enlarged perspective view of the piston member for the pressurizable container assembly of FIG. 1.
Figure 1:
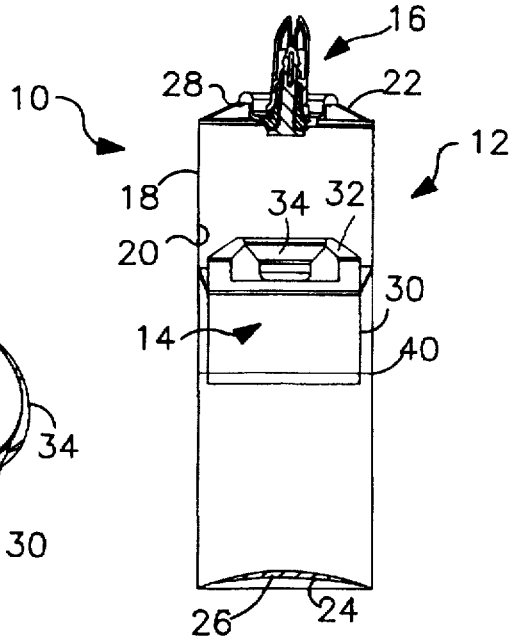
FIG. 1 is a cross-sectional, elevational view of the pressurizable container assembly of the present invention.
Figure 3:
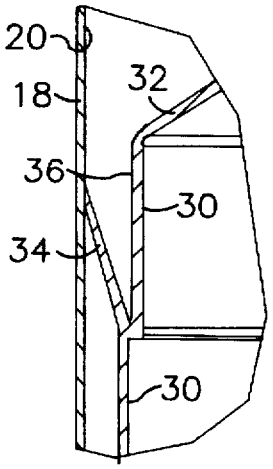
FIG. 3 is an enlarged partial cross-sectional view of the piston member in sliding contacting relationship with the inner surface of the container of the pressurizable container assembly.

Referring now to the drawings, and in particular FIG. 1, there is illustrated a pressurizable container assembly, generally indicated as 10, comprised of a container member, a piston member and a valve assembly, generally indicated as 12, 14 and 16, respectively.

The container member 12 is comprised of a cylindrically-shaped sidewall 18 defining an inner surface 20, an upper frusto-conically shaped top wall portion 22 and a bottom wall portion 24 including a pressurizing orifice 26. A ring member 28 is mounted about an upper end of the top wall portion 22 of the container assembly 10 to cooperate with the valve assembly 16, as more fully hereinafter described. The container member 12 is generally formed of a metallic material, such as aluminum or the like.

The piston member 14 is comprised of a cylindrically-shaped body portion 30 enclosed at the top by an end wall portion 32 formed with a chamber 34 generally contoured to the shape of the valve member 16. The cylindrically-shaped body portion 30 is spaced apart from the inner surface 20 of the container member 12 a distance sufficient to accommodate bumps or dents along the container body 18 extending into the container body 20, i.e., the outer diameter of the sidewall 30 is smaller than the diameter of the inner surface 20 of the container member by at least about 0.3 cm.(0.12") preferably about 0.4 cm. (0.16").

Figure 4:
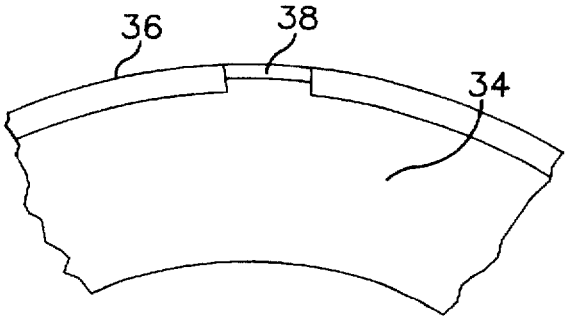
FIG. 4 is an enlarged partial view of the wall portion of the piston member.

The piston member 14 is formed with a frusto-conically shaped wall portion 34 extending upwardly and outwardly from an upper section of the body portion 30. The frusto-conically shaped wall portion defines a cylindrically-shaped wiping edge 36 dimensioned to contact the inner surface 20 of the cylindrically-shaped body portion 20 of the container assembly 10. The frusto-conically shaped wall portion 34 is formed with radially disposed segmented sections 38 of reduced thickness referring particularly to FIG. 4 to provide flexibility or compliance to the wall portion 34 during upward movement of the piston member to permit the wiping edge 36 to facilely ride over imperfections, such as dents, bumps and the like. Alternately, the diameter of the body member is smaller than the diameter of the inner surface an amount to accommodate usual container inspections.

Proximate the lower end of the body portion 30, the piston member is provided an annularly-shaped ring portion 40 of substantially like the outer diameter of the inner surface 20 of the container body 18 to permit coaxial movement of the piston member 14 within the container body 28 of the container assembly 12.

The valve assembly 16 is mounted on the ring 28 in a manner known to one skilled in the art after product filling within the container body 78. Thereafter, a suitable compressed gas, such as carbon dioxide and the like, is introduced into the container body 18 through the orifice 26 in the bottom wall 24 thereof with the orifice being subsequently sealed by a suitable plug member (not shown).

In accordance with the present invention, as the wiping edge 36 encounters a bump or imperfection, the wiping edge flexes out of the way instead of compressing as with prior art devices thereby eliminating potential concomitant piston stall. Thus, deformation is taken up by the wiping edge 36, and if segments 38 are included by the segment(s) 38 moving close together.

Additionally, it will be appreciated by one skilled in the art that the configuration of the piston member permits easy molding since the piston members may be pulled out of the mold cavity thereby eliminating mechanical slide and the like normally required to remove piston members formed with more rigid upper wiper walls of the prior art.

While the invention herein has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. A pressurizable container assembly which comprises:

a container body having a cylindrically-shaped side wall, including a cylindrically-shaped inner surface defining a product chamber, said container body having a top wall portion including an orifice;

a valve assembly mounted about said orifice of said top wall portion; and a piston member having a cylindrically-shaped body portion enclosed by a top end wall portion and formed with a frusto-conically shaped intermediate wall portion defining a circularly-shaped wiping edge and extending upwardly and outwardly from said body portion, said intermediate wall portion being formed with radially-disposed segments of smaller thickness extending from said wiping edge, said body portion of said piston member being of a smaller diameter than an inner diameter of said cylindrically-shaped inner surface to permit flexing of said wiping edge over imperfections in said container body extending into said product chamber.

2. The pressurizable container assembly as defined in claim 1 wherein said cylindrically-shaped body portion of said piston member is of a diameter less than about 0.3 cm. of a diameter of said inner surface of said cylindrically-shaped sidewall.

3. The pressurizable container assembly as defined in claim 2 wherein said diameter of said cylindrically-shaped body portion of said piston member is about 0.4 cm. less than said diameter of said inner surface of said cylindrically-shaped sidewall.

4. The pressurizable container assembly as defined in claim 1 wherein said piston member is formed with an annular ring portion about said body portion proximate a lower portion thereof.

5. A piston member for a pressurizable container assembly, which comprises:

a cylindrically-shaped body portion;

an end wall portion enclosing a top of said body portion; and a frusto-conically shaped intermediate wall member extending upwardly and outwardly from said body portion and defining a ring-shaped wiping edge, said intermediate wall member being formed with radially-disposed segments of smaller thickness.

6. The piston member for a pressurizable container assembly as defined in claim 5 wherein a diameter of said cylindrically-shaped body portion is of a diameter less than about 0.3 cm. of a diameter of said ring-shaped wiping edge.

7. The pressurizable container assembly as defined in claim 5 wherein said piston member is formed with an annular ring portion about said body portion proximate a lower end thereof.

* * * * *